United States Patent [19]

Vosbikian

[11] Patent Number: 4,650,074

[45] Date of Patent: Mar. 17, 1987

[54] TOOL DISPLAY PACKAGE

[75] Inventor: Mike Vosbikian, Medford, N.J.

[73] Assignee: Hardware & Industrial Tool Co., Inc., Cinnaminson, N.J.

[21] Appl. No.: 813,388

[22] Filed: Dec. 26, 1985

Related U.S. Application Data

[63] Continuation of Ser. No. 658,318, Oct. 5, 1984.

[51] Int. Cl.[4] ..... B65D 73/00

[52] U.S. Cl. ..... 206/477; 206/44.11; 206/45.14; 206/349; 206/495; 206/806

[58] Field of Search ..... 206/44 B, 44.11, 45.14, 206/294, 346, 347, 349, 471, 477, 488, 480, 493, 495, 806; 411/119, 378

[56] References Cited

U.S. PATENT DOCUMENTS

| | | | |
|---|---|---|---|
| 2,684,758 | 7/1954 | Aquino | 206/349 |
| 3,516,585 | 6/1970 | Inwood | 206/349 |
| 3,892,313 | 7/1975 | Lange | 206/347 |
| 3,963,123 | 6/1976 | Beal | 206/495 |
| 4,420,082 | 12/1983 | Bernie | 206/806 |
| 4,450,961 | 5/1984 | Bies et al. | 206/349 |
| 4,485,917 | 12/1984 | Smith | 206/806 |

*Primary Examiner*—Joseph Man-Fu Moy
*Assistant Examiner*—David T. Fidei
*Attorney, Agent, or Firm*—Steele, Gould & Fried

[57] ABSTRACT

A tool display package is disclosed which includes a display card to be removably connected to a tool of the type including a projecting nut. An opening is provided near the bottom of the card of size and configuration to overfit and to frictionally engage the nut. A plastic cap is provided with an interior recess of dimensions to frictionally engage the nut over the card to releasably secure the card to the tool. By removing the cap, the card can be separated from the tool by pulling sufficiently to overcome the frictional engagement forces. After the card has been removed and the tool is ready for use, the cap can be reapplied over the nut to provide a finished appearance.

5 Claims, 4 Drawing Figures

TOOL DISPLAY PACKAGE

This is a continuation, of application Ser. No. 658,318, filed Oct. 5, 1984.

BACKGROUND OF THE INVENTION

1. Field of the Invention

The present invention relates generally to the field of article display packages, and more particularly, is directed to a self-contained easily attached and easily removed, point of purchase tool display package.

2. Description of the Prior Art

In order to prepare most articles for market, it is the common practice of manufacturers to provide various types of packages to contain the article in a manner to indicate the contents of the package. This indication can be by printed and graphic materials applied directly to the container or by employing packaging that permits visual display of the contents of the package. Many types of article display packaging have been commonly employed by prior workers in the art and such packages can vary all the way from simple, clear plastic bags to rather elaborate combination cardboard boxes both with and without clear view panels. The prior art containers have usually been imprinted on one or more sides to provide such information as the type of product contained therewithin, the name and address of the manufacturer, perhaps instructions for use, one or more trademarks, warnings, warranties, etc.

Many of the prior art packages have been developed in the so-called bubble configuration wherein a sheet of clear, relatively rugged, plastic material is vacuum formed or otherwise applied about the article to be displayed in combination with an enclosing cardboard header or backer. In the so-called bubble display packages, the article itself was always completely incapsulated between the clear plastic and the cardboard in such a manner that whereby the article could be readily viewed, it could not be touched, manipulated or otherwise handled without damaging the packaging material.

SUMMARY OF THE INVENTION

The present invention relates generally to the field of package designs, and more particularly, is directed to a display package that can be easily affixed to and removed from an article such as a hand tool in a manner to permit easy manipulation of the tool without requiring damage or removal of the packaging.

The display package of the present invention is particularly useful with the small hand tools, such as garden tools and includes in combination a display card which can be readily printed on both sides to set forth information relating to such matters as the proper use of the tool, care of the tool, and other pertinent information desired to be conveyed to the purchaser by the manufacturer. Preferably, the card includes a suitable opening for hanging association with a peg or other type of projection commonly employed on many point of purchase article display racks.

In a preferred embodiment, the card is provided with a hexagonal or other shaped opening of size and configuration to overfit a securing nut that is conventionally provided as part of the pivotal arrangement in a pivoting type of tool, such as a garden pruner or shears. The card shaped opening is designed to snugly fit upon the hex or otherwise shaped nut in a manner to frictionally associate the card with the pruner. A smooth surfaced, removable cap or cover is provided exteriorly of the card to frictionally engage the same pivot nut over the card in a manner to prevent easy disassociation of the parts. The cap or cover is designed to frictionally engage the pivot nut in such a snug manner as to require the employment of a prying implement, such as a screwdriver, knife or the like in order to disassociate the cap from the nut in order to expose the card for removal. Once the card has been removed, the cap can be reinserted over the nut to cover the nut and thereby provide a finished appearance during the entire useful life of the tool.

It is noteworthy that the card attaches externally to the tool and is positioned on one side thereof. Preferably, the nut contacting opening is positioned near the bottom of the card, thereby leaving the tool-operating handles entirely free and clear of the card configuration. In this manner, a person desiring to more closely inspect the tool prior to purchase can pick up the tool, can handle the grips, can squeeze the grips together to function the pivotal jaws and can otherwise easily manipulate the tool to see exactly how it works and exactly how it feels, all without interference with the display packaging and without in any manner damaging or requiring removal of the package prior to purchase.

It is therefore an object of the present invention to provide an improved tool diplay package of the type set fo:th.

It is another object of the present invention to provide a novel tool display package that includes a planar card, an opening in the card of size and configuration to frictionally engage an exposed nut or other projection on the article to be vended and a blank cover adapted to be frictionally engaged on the nut or other projection over the display card.

It is another object of the present invention to provide a novel tool display package that includes means to affix the package to the tool without interfering with access to the tool in combination with means to removably secure the display package to the tool.

It is another object of the present invention to provide a novel tool display package that includes planar card means having a hex-shaped opening therein, a hex-shaped nut affixed to a portion of the tool to be displayed and a plain, smooth cap overfitting the nut and securing the card between the cap and the tool in a manner to expose portions of the tool to manipulation without requiring removal the card.

It is another object of the present invention to provide a novel tool display package that is inexpensive in manufacture, simple in installation and easily removable when the tool is in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
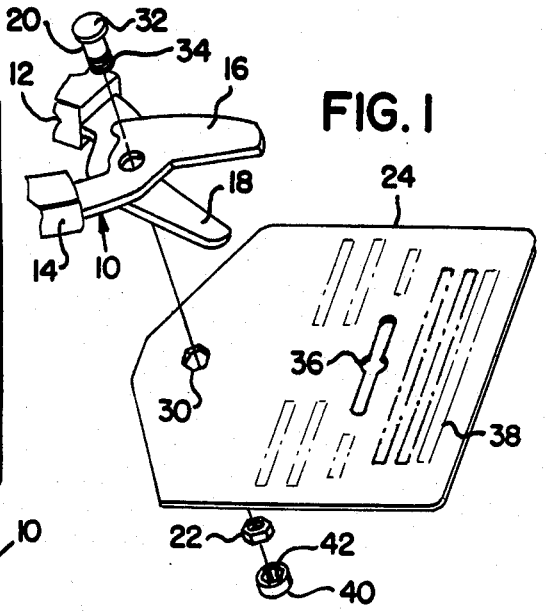
FIG. 1 is an exploded perspective view showing the display card in combination with a pivoting type of tool.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated the tool display package of the present invention which comprises generally a separable display card 24 which can be easily and removably associated with a hand tool, for example, a pruning shear 10 as illustrated. In the illustrated embodiment, the pruning shear comprises a pair of pivotally arranged handles 12, 14 which are attached to and designed to conventionally pivotally open and close a pair of cooperating jaws 16, 18. A pivot bolt 20 of conventional design comprises an enlarged bolt held 32 and a shank of suitable length to extend through the transition pieces between the handles and the jaws. The bolt shank includes threads 34 in well known manner to threadedly endwardly engage a pivot bolt nut 22 in a relatively common type of construction.

The display card 24 is designed to exteriorly affix to the tool 10 in a removable manner at the pivot bolt nut 22 thereof. See FIGS. 3 and 4. As best seen in FIGS. 1 and 4, the display card 24 is provided with a nut engaging opening 30 of size and configuration to slide over the exterior periphery of the nut 22 and to be frictionally engaged thereon. In the illustrated embodiment, the nut 22 and the card opening 30 are both shaped to cooperating hexagonally-shaped configurations. It will be appreciated that other cooperating configurations could also be similarly utilized so long as an interacting engagement can be provided. Preferably, the nut receiving opening 30 is positioned near the bottom of the display card 24 whereby the card can be removably affixed to the tool 10 in a manner to leave almost completely exposed the tool handles or grips 12, 14. Accordingly, when the display card 24 is secured to the hand tool 10 at the pivot bolt 20 thereof, the tool grips 12, 14 will be completely exposed, to thereby permit a purchaser to grasp the tool handles and to function the tool jaws 16, 18 about the pivot bolt 20 without in any manner disturbing the display card.

Figure 3:
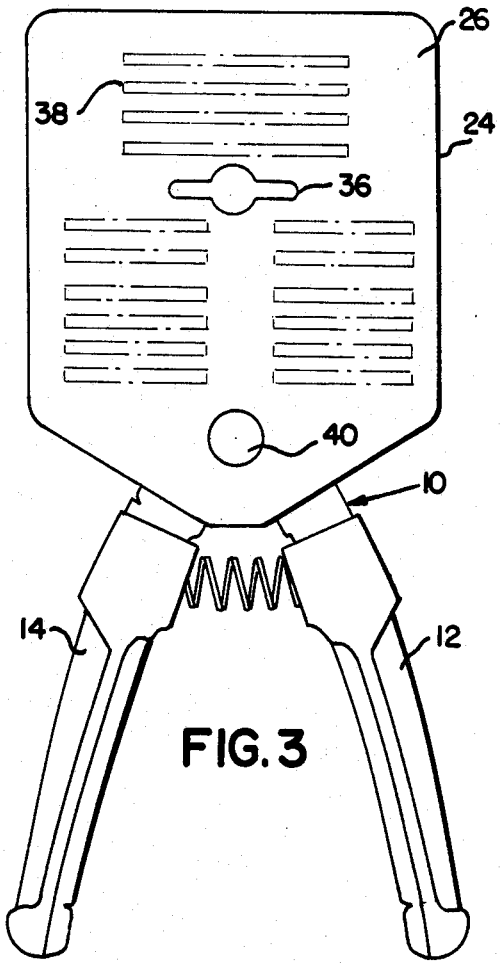
FIG. 3 is a front elevational view, on enlarged scale, showing the display card affixed to the pruner.
Figure 4:
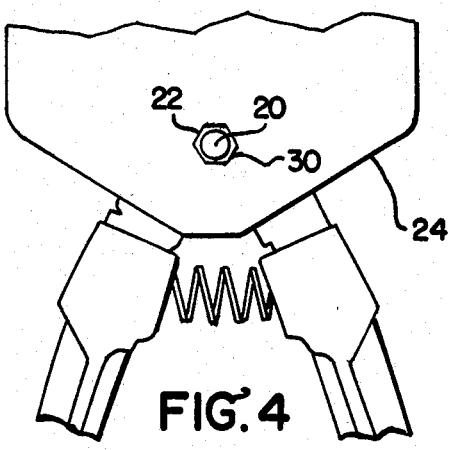
FIG. 4 is a partial, elevational view similar to FIG. 3, showing the locking cover removed prior to removal of the display card.

As illustrated in FIGS. 1 and 3, a plain, smooth cover or cap 40 is provided with a hex-shaped or other cooperating shaped recess 42 of proper size and configuration to frictionally slide over and engage upon the pivot bolt nut 22 in a manner to cover the nut and a portion of the display card 24 about the engaging opening 30. The cap 40 frictionally engages the nut 22 and functions to prevent easy removal of the cover or cap and also the display card 24. It will be appreciated that the outer periphery of the cover 40 is fabricated to dimensions that are greater than the dimensions of the hex-shaped opening 30 provided in the display card and accordingly, the card 24 cannot be removed from its association with the tool 10 without tearing, unless the cover 40 is first removed. In view of the frictional engagement of the cover 40 upon the pivot bolt nut 22, it is contemplated that a prying tool such as a conventional screw driver or common knife can be employed to slip the cover 40 outwardly of the nut 22 to thereby allow easy removal of the card 24. See FIG. 4. It is contemplated that the cover or cap 40 can best be fabricated of molded plastic material, however, other suitable materials could also be employed for this purpose.

Preferably, either or both the display card front 26 and/or back 28 can be imprinted with any desired indicia 38 which the manufacturer desires to apply thereto. Accordingly, such indicia as a trademark, instructions for use, instructions for care, warranties, advertising materials, etc. can be applied to the card in any desired manner to interest the prospective purchasers and to help sell the tool 10. At the point of purchase, the tool can be readily picked up, grasped, manipulated by squeezing the handles 12, 14 and in general can be relatively completely exposed to allow the prospective purchaser an unusual degree of freedom in operation to determine exactly how the tool functions and to provide a full disclosure of the tool itself. The display card 24 serves to give additional information about the tool while, at the same time, permitting complete access, to thereby allow the prospective purchaser full freedom in trying the tool prior to purchase.

Figure 2:
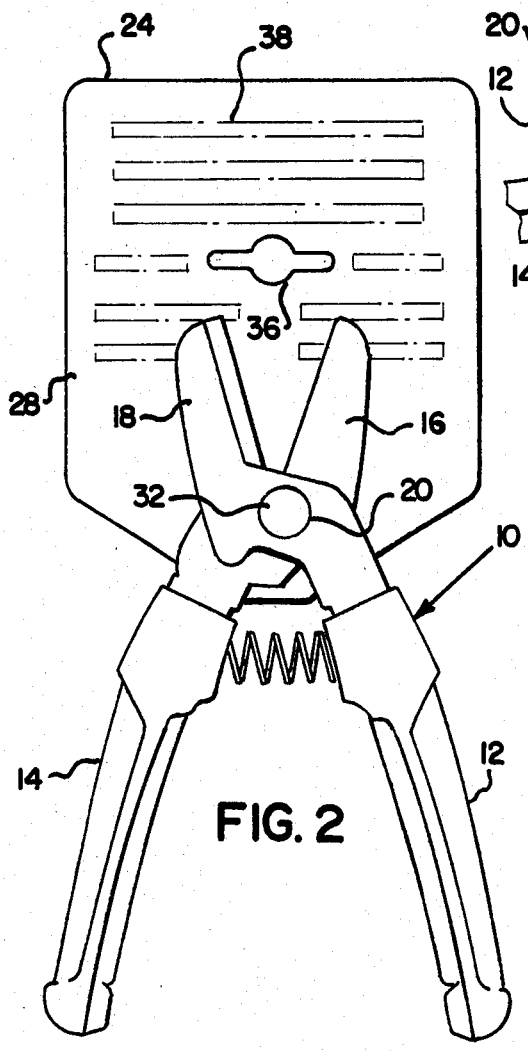
FIG. 2 is a rear elevational view on enlarged scale, showing the display card affixed to the pruner.

As illustrated in FIGS. 1, 2, and 3, if desired, a hanger opening 36 can be punched or otherwise formed in the display card 24 of suitable shape to permit the tool to be hung in the usual manner upon a hanger or hook of any one of a number of conventional types of merchandise display racks which are commonly employed in retail establishments.

After purchase, the decorative cover or cap 40 can be removed from its frictional association with the nut 22 in the manner illustrated in FIG. 4 and the card 24 can then be axially outwardly urged relative to the bolt 20 until the display card 24 has worked free. The display card 24 can then either be discarded or stored for future reference, as may suit the desires of the purchaser. Once the card 24 has been removed from its association with its pivot bolt nut 22, it is contemplated that the cap 40 will then be reapplied over the nut where it will be frictionally engaged to thereby provide a more finished appearance to the tool 10 during all future periods of use.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A display card package for attaching to a tool of the type having a configured projection extending outwardly therefrom and a pair of operating handles below the projection for hanging and displaying the tool comprising a card having at least one edge, a front and a back, the card being provided with a complementary configured opening to engage the tool by receiving the said projection therethrough in a manner to removably associate the card with the tool, the opening being positioned near the said one edge, the operating handles of the tool extending below the said one edge when the configured projection is inserted into the configured opening; and a cap in frictional engagement with the configured projection, the friction of the frictional engagement being sufficient to require an external prying implement to disassociate the cap from the projection, the cap being adapted for first and second frictional engagements with the configured projection, the cap overfitting and contacting the back of the card to secure the card to the tool when in the said first frictional engagement, the card being removable from the tool without tearing only when the cap is removed from engagement with the configured projection, the cap being reapplied over the configured projection in the second frictional engagement after removal of the card;

whereby the operating handles may be grasped and moved without removing the card from the tool in the first frictional engagement and whereby the card is removed and the cap covers the configured projection in the second frictional engagement.

2. The display card package of claim 1 wherein the configured projection is a nut and wherein the cross sectional shape of the nut is polygonal.

3. The display card package of claim 2 wherein the shape of the nut is hexagonal and wherein the cap is provided with an interior recess of size and configuration to frictionally grip the nut.

4. The display card package of claim 2 and hanger means provided in the card to hang the tool for display purposes, the hanger means comprising a second opening in the card, the second opening being spaced away from the said complementary configured opening.

5. The display card package of claim 4 wherein the card comprises a longitudinal axis and wherein both thc complementary configured opening and the second opening in the card are positioned to be symmetrical about the said axis.

* * * * *